US009756963B2

(12) United States Patent
Bien-Willner

(10) Patent No.: US 9,756,963 B2
(45) Date of Patent: Sep. 12, 2017

(54) BABY CRIB THAT ASSEMBLES OR DISASSEMBLES WITH ENHANCED EFFICIENCY

(71) Applicant: Ruben Bien-Willner, Tucson, AZ (US)

(72) Inventor: Ruben Bien-Willner, Tucson, AZ (US)

( * ) Notice: Subject to any disclaimer, the term of this patent is extended or adjusted under 35 U.S.C. 154(b) by 0 days.

(21) Appl. No.: 15/153,437

(22) Filed: May 12, 2016

(65) Prior Publication Data

US 2016/0338505 A1 Nov. 24, 2016

Related U.S. Application Data

(60) Provisional application No. 62/165,498, filed on May 22, 2015.

(51) Int. Cl.

| | |
|---|---|
| ***A47D 9/00*** | (2006.01) |
| ***A47D 7/00*** | (2006.01) |
| ***A47D 7/03*** | (2006.01) |

(52) U.S. Cl.

CPC ..... *A47D 9/00* (2013.01); *A47D 7/005* (2013.01); *A47D 7/03* (2013.01)

(58) Field of Classification Search

CPC . A47D 7/00; A47D 9/00; A47D 7/005; A47D 7/03; A47D 7/02; A47B 47/047; A47B 47/06

USPC ..... 312/263, 264

See application file for complete search history.

(56) References Cited

U.S. PATENT DOCUMENTS

| | | | | | |
|---|---|---|---|---|---|
| 2,720,253 | A * | 10/1955 | Turner | A47B 3/06 | 248/174 |
| 3,797,054 | A * | 3/1974 | Sly | A47C 4/021 | 5/101 |
| 4,926,759 | A * | 5/1990 | Vitsky | A47B 47/06 | 108/180 |
| 5,016,301 | A * | 5/1991 | Combs | A47D 9/02 | 5/101 |
| 6,256,813 | B1 * | 7/2001 | Aaron | A47C 21/046 | 5/100 |
| 6,973,686 | B2 | 12/2005 | Kenan | | |
| 7,300,110 | B1 * | 11/2007 | Debien | A47C 3/0257 | 297/181 |
| D643,644 | S * | 8/2011 | Ehrlich | D6/385 | |
| 2004/0025251 | A1 * | 2/2004 | Arthur | A47D 7/02 | 5/110 |
| 2004/0056526 | A1 | 3/2004 | Willy | | |
| 2012/0073044 | A1 * | 3/2012 | Lake | A47D 7/002 | 5/99.1 |
| 2012/0137429 | A1 * | 6/2012 | Aaron | A47D 7/005 | 5/93.1 |

(Continued)

*Primary Examiner* — Eric Kurilla

(74) *Attorney, Agent, or Firm* — Plager Schack LLP

(57) ABSTRACT

A baby crib includes a plurality of panels coupled together and having a pair of side panels and a pair of end panels. The side panels are oriented generally parallel relative to one another with each side panel having a top edge, a bottom edge, a first side edge and a second side edge. The pair of end panels include a first end panel slidably mounted to the side panels proximate the first side edges and a second end panel slidably mounted to the side panels proximate the second side edges. A plurality of support members are detachably coupled to the pair of side panels and are able to support a platform. Each support member is coupled to the side panels in one of a plurality of height positions. The plurality of support members are designed to support a mattress.

4 Claims, 4 Drawing Sheets

(56) References Cited

U.S. PATENT DOCUMENTS

| | | | | |
|---|---|---|---|---|
| 2012/0297537 | A1* | 11/2012 | Gutierrez | A47D 7/03 5/93.1 |
| 2013/0180047 | A1* | 7/2013 | Veronneau | A47D 7/005 5/93.2 |
| 2014/0165289 | A1 | 6/2014 | Trocchia | |

* cited by examiner

BABY CRIB THAT ASSEMBLES OR DISASSEMBLES WITH ENHANCED EFFICIENCY

RELATED APPLICATION

The application claims priority to provisional patent application U.S. Ser. No. 62/165,498 filed on May 22, 2015, the entire contents of which is herein incorporated by reference.

BACKGROUND

The embodiments herein relate generally to baby cribs.

Cribs are beds with enclosed sides, which are used for babies or children. Baby cribs can be difficult to assemble and typically require a user to secure the components together by using mechanical fasteners such as screws, nuts or bolts, and tools or other hardware. This can be problematic because small components such as the fasteners can easily be dropped, misplaced or lost, which frustrates the user and wastes time.

Several furniture and crib devices comprise components that can be assembled with little or no tools as disclosed in U.S. Patent Application Publications 2014/0165289 and 2004/0056526, and U.S. Pat. No. 6,973,686. However, these cribs and/or furniture items are limited for a variety of reasons. Specifically, the cribs and/or furniture items cannot be easily adjusted to conform to the user's preferences, which may include different height settings for a mattress. Further, several of these furniture items lack effective locking members to help secure their components together when in use.

As such, there is a need in the industry for a baby crib with enhanced stability that overcomes the limitations of the prior art, which can be assembled or disassembled with improved efficiency.

SUMMARY

A baby crib configured to be assembled or disassembled with enhanced efficiency without the use of tools is provided. The baby crib comprises a plurality of panels coupled together and comprising a pair of side panels and a pair of end panels, the pair of side panels oriented generally parallel relative to one another with each side panel comprising a top edge, a bottom edge opposite the top edge, a first side edge coupled to the top and bottom edges, and a second side edge coupled to the top and bottom edges, the pair of end panels comprising a first end panel slidably mounted to the side panels proximate the first side edges and a second end panel slidably mounted to the side panels proximate the second side edges, and a plurality of support members detachably coupled to the pair of side panels and configured to support a platform, each support member configured to be coupled to the side panels in one of a plurality of height positions, wherein the plurality of support members are configured to support a mattress disposed thereon.

In certain embodiments, the baby crib comprises a pair of locking members coupled to the pair of side panels and pair of end panels. Each locking member comprises a pair of notches and a pair of protrusions.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
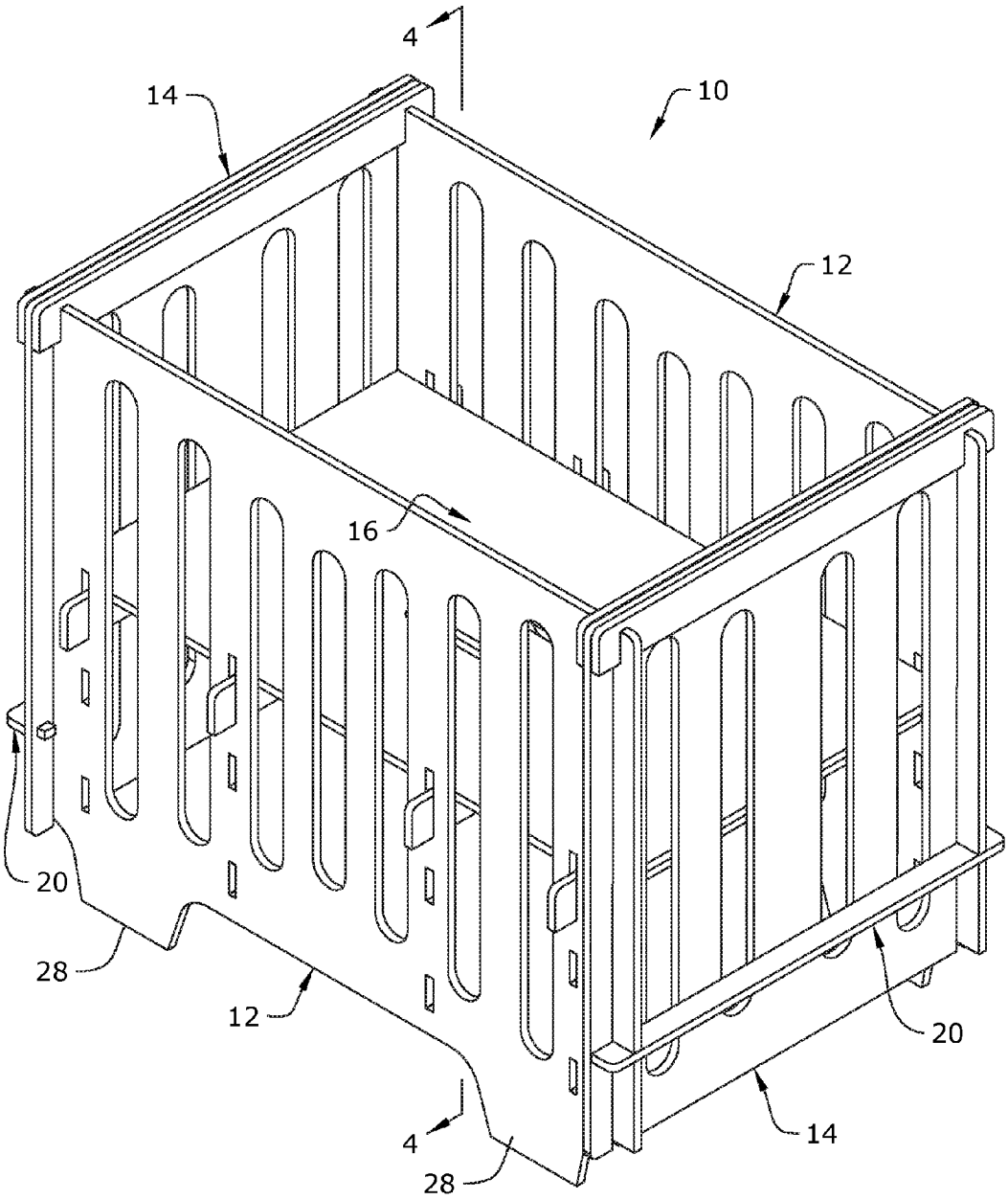
FIG. 1 depicts a perspective view of certain embodiments of the baby crib shown in use.
Figure 2:
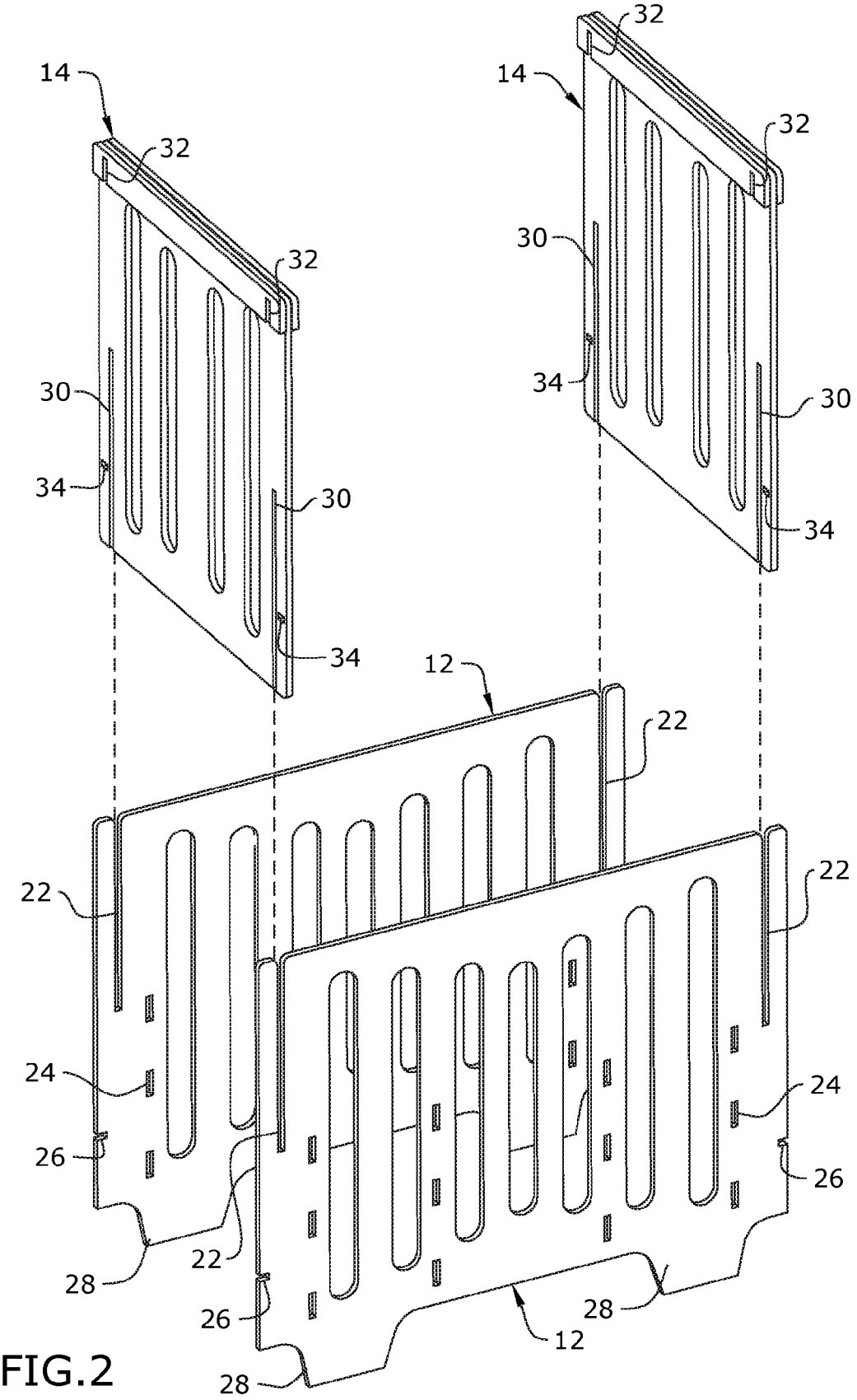
FIG. 2 depicts an exploded view of certain embodiments of the baby crib.
Figure 3:
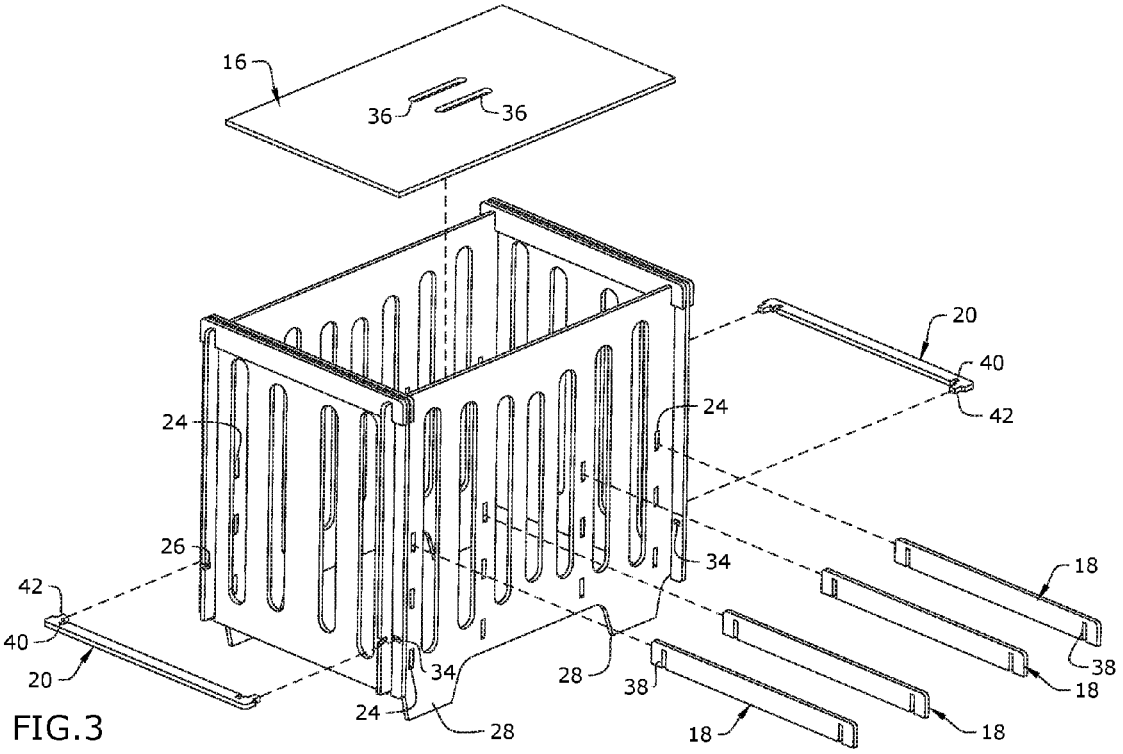
FIG. 3 depicts an exploded view of certain embodiments of the baby crib.

As depicted in FIGS. 1-3, crib 10 is configured to be easily assembled or disassembled with enhanced efficiency and without the need for tools or mechanical fasteners. Crib 10 generally comprises side panels 12, end panels 14, platform 16, support members 18 and locking members 20. Platform 16 is configured to support a mattress (not shown) within side panels 12 and end panels 14. In a preferred embodiment, the components of crib 10 are made from approximately ½" plywood. However, alternative materials known in the field may be used instead such as corrugated plastic, metals or other materials.

Each side panel 12 comprises support member slots 24, upper elongated slots 22, locking slots 26 and feet 28. Feet 28 of each side panel 12 is configured to contact the ground and provide stability to crib 10. Upper elongated slots 22 extend from the top edge of each side panel 12 to central portions of the panel. Upper elongated slots 22 are located proximate the side edges of each side panel 12. In one embodiment, each side panel 12 comprises a plurality of sets of support member slots 24, wherein each set comprises support member slots 24 aligned with each other and positioned generally perpendicular to a longitudinal axis of side panel 12. Although the figures depict four sets of support member slots 24, it shall be appreciated that any alternative number of sets and/or number of support member slots 24 may exist.

The pair of side panels 12 are oriented generally parallel to one another and are slidably mounted to end panels 14. Each end panel 14 comprises lower elongated slots 30, upper slots 32 and locking member openings 34. Lower elongated slots 30 extend from the bottom edge of each end panel 14 to central portions of the panel. Lower elongated slots 30 are located proximate the side edges of each end panel 14.

Lower elongated slots 30 of each end panel 14 are configured to receive upper elongated slots 22 of adjacent ends of the pair of side panels 12 as depicted in FIG. 2. Once connected together, upper slots 32 of each end panel 14 receive top edges of side panels 12 therein to secure the connection. As depicted in FIG. 3, side panels 12 and end panels 14 in the connected configuration creates the outer walls of crib 10.

Figure 4:
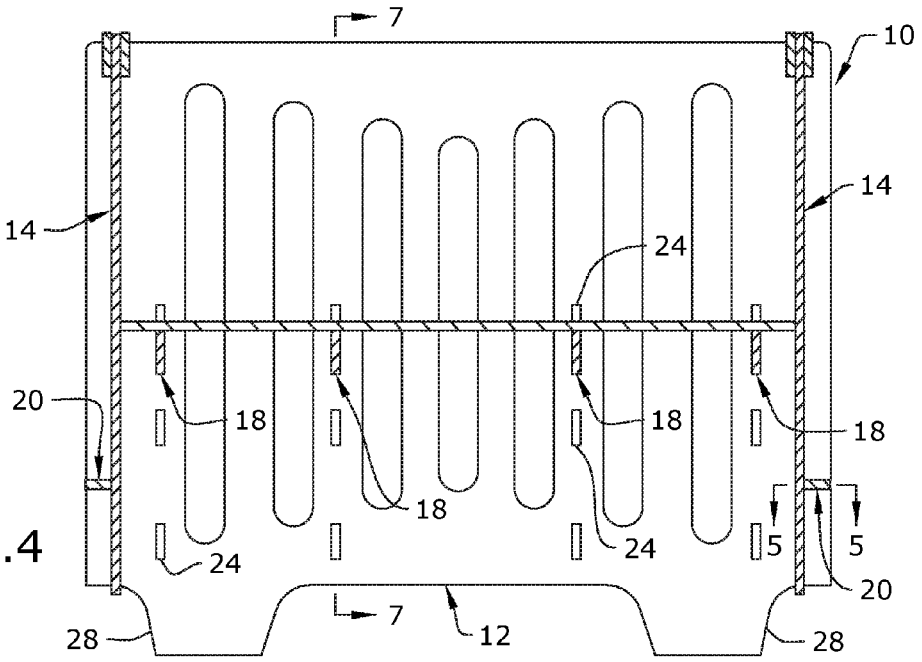
FIG. 4 depicts a section view of certain embodiments of the baby crib taken along line 4-4 in FIG. 1.
Figure 7:
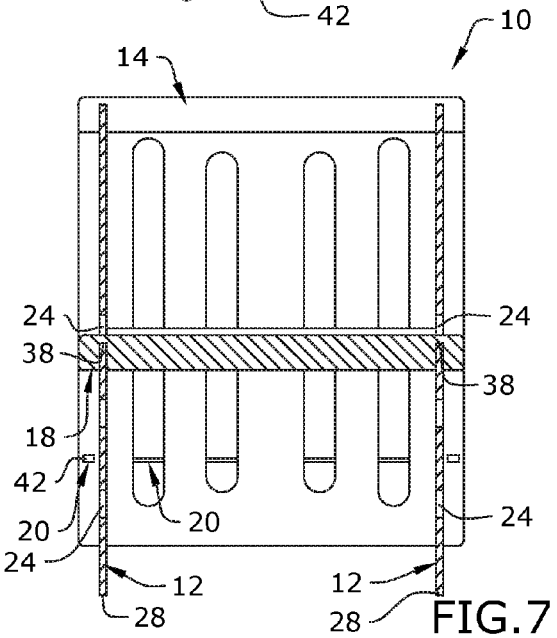
FIG. 7 depicts a section view of certain embodiments of the baby crib taken along line 7-7 in FIG. 4.

Support member slots 24 of side panels 12 are configured to receive support members 18. Each support member 18 comprises a pair of notches 38 on opposing ends. As depicted in FIGS. 4 and 7, each support member 18 is configured to be inserted through one support member slot 24 of the first side panel 12 and another corresponding support member slot 24 of the second side panel 12, wherein the pair of support member slots 24 receiving support member 18 are at the same height. Once secured in place, side panels 12 are configured to sit within notches 38 of support member 18. Additional support members 18 may be inserted within support member slots 24 of both side panels 12. A plurality of support members 18 coupled to side panels 12 provides a structure to support platform 16.

Platform 16 is configured to support a mattress (not shown) within side panels 12 and end panels 14. In one embodiment, platform 16 comprises grip slots 36, which permit a user (not shown) to easily grab when maneuvering platform 16 in and out of crib 10. It shall be appreciated that the mattress may have variable dimension depending on the dimensions of crib 10. In one embodiment, the mattress has dimensions of approximately a 27¼" width, a 51⅝" length and a height no greater than 6". In an alternative embodiment, the mattress has dimensions of approximately a 23" width, a 38½" length and a height no greater than 6".

Figure 5:
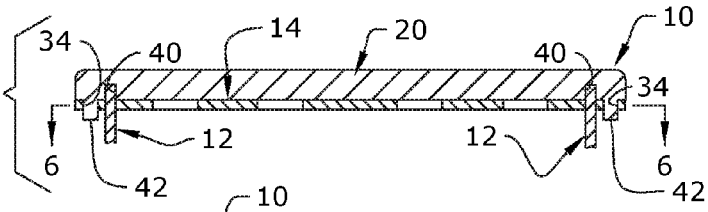
FIG. 5 depicts a section view of certain embodiments of the baby crib taken along line 5-5 in FIG. 4.
Figure 6:
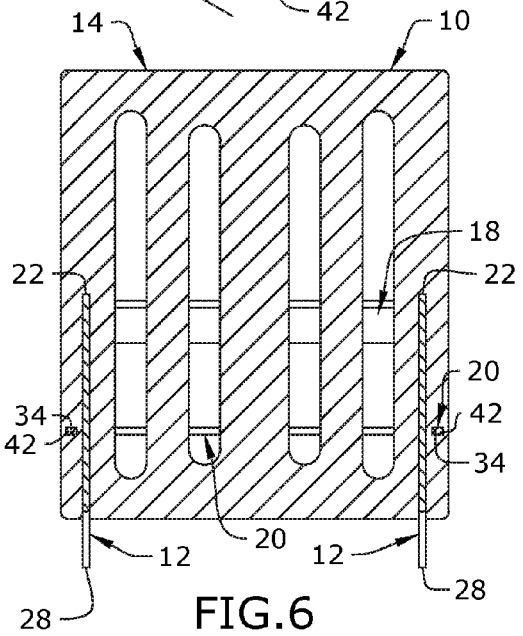
FIG. 6 depicts a section view of certain embodiments of the baby crib taken along line 6-6 in FIG. 5.

A pair of locking members 20 are configured to couple to both side panels 12 and end panels 14 to enhance strength and stability of crib 10 in the assembled configuration. Each locking member 20 comprises a pair of notches 40 and a pair of protrusions 42. The pair of protrusions 42 are located on opposing ends of locking member 20. The pair of notches 40 are located on opposing ends of locking member 20 and situated proximate the pair of protrusions 42. As depicted in FIGS. 5-6, each locking member 20 is maneuvered to permit protrusions 42 to engage with locking member openings 34 of each end panel 14. At the same time, notches 40 of each locking member 20 are configured to engage with locking slots 26 of side panels 12. Locking members 20 can easily engage and disengage with both side panels 12 and end panels 14 as needed.

In operation, side panels 12, end panels 14, support members 18, platform 16 and locking members 20 are assembled together to construct crib 10 as shown in FIG. 1. A mattress (not shown) is disposed on platform 16. Since side panels 12 comprise a plurality of support member slots 24, support members 18 can be rearranged therein to permit platform 16 to support the mattress at different heights. Crib 10 is advantageous because it can be easily assembled or disassembled without the use of tools or mechanical fasteners. Locking members 20 enhance the strength and stability of crib 10 and prevent the components from detaching from one another.

It shall be appreciated that the components of crib 10 described in several embodiments herein may comprise any alternative known materials in the field and be of any color, size and/or dimensions. It shall be appreciated that the components of crib 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A baby crib configured to be assembled or disassembled without the use of tools, the baby crib comprising:

a plurality of panels coupled together, the plurality of panels comprising a pair of side panels and a pair of end panels, the pair of side panels oriented generally parallel relative to one another with each side panel comprising a top edge, a bottom edge opposite the top edge, a first side edge coupled to the top and bottom edges, and a second side edge coupled to the top and bottom edges, the pair of end panels comprising a first end panel slidably mounted to the side panels proximate the first side edges and a second end panel slidably mounted to the side panels proximate the second side edges; and a plurality of support members detachably coupled to the pair of side panels and configured to support a platform, each support member configured to be coupled to the side panels in one of a plurality of height positions, wherein the plurality of support members are configured to support a mattress disposed thereon;

wherein each side panel of the pair of side panels comprises a first elongated slot proximate the first side edge and a second elongated slot proximate the second side edge, the first and second elongated slots extending from the top edge of each side panel to central portions of each side panel, wherein each end panel of the pair of end panels comprises a pair of elongated slots extending from a bottom edge of each end panel to central portions of each end panel, wherein the pair of elongated slots of each end panel are configured to receive either the first elongated slots or second elongated slots of the pair of side panels;

wherein each end panel of the pair of end panels comprises a pair of upper slots configured to receive the top edges of the pair of side panels:

a pair of locking members coupled to the pair of side panels and the pair of end panels, each locking member comprising a pair of notches and a pair of protrusions;

wherein each end panel of the pair of end panels comprises a pair of openings configured to engage with the pair of protrusions in one of the pair of locking members, wherein each side panel of the pair of side panels comprises a first locking slot coupled to the first side edge and a second locking slot coupled to the second side edge, wherein the pair of notches of each locking member is configured to engage with either the first locking slots or second locking slots of the pair of side panels.

2. The baby crib of claim 1, wherein each side panel of the pair of side panels comprises a plurality of support member slots, the plurality of support member slots comprising at least a first set of slots and a second set of slots, the slots of each of the first and second sets of slots positioned generally perpendicular to a longitudinal axis of each side panel, wherein each support member is configured to detachably couple with any pair of slots in the first set of slots or second set of slots in the pair of side panels, thereby adjusting each support member to a desired height.

3. The baby crib of claim 2, where each support member comprises a pair of notches configured to receive the pair of side panels.

4. The baby crib of claim 3, wherein each side panel of the pair of side panels comprises a pair of feet.

* * * * *